US008746375B2

(12) United States Patent
Hendrik et al.

(10) Patent No.: US 8,746,375 B2
(45) Date of Patent: Jun. 10, 2014

(54) WELLBORE TOOLS HAVING SUPERHYDROPHOBIC SURFACES, COMPONENTS OF SUCH TOOLS, AND RELATED METHODS

(75) Inventors: John Hendrik, Celle (DE); Sunil Kumar, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 446 days.

(21) Appl. No.: 13/111,825

(22) Filed: May 19, 2011

(65) Prior Publication Data

US 2012/0292117 A1 Nov. 22, 2012

(51) Int. Cl.
*E21B 10/46* (2006.01)

(52) U.S. Cl.
USPC ..... 175/374; 175/425

(58) Field of Classification Search
USPC ..... 175/374, 425
See application file for complete search history.

(56) References Cited

U.S. PATENT DOCUMENTS

| | | | | |
|---|---|---|---|---|
| 5,542,486 | A | 8/1996 | Curlett et al. | |
| 5,651,420 | A | 7/1997 | Tibbitts et al. | |
| 6,260,636 | B1 | 7/2001 | Cooley et al. | |
| 6,450,271 | B1 * | 9/2002 | Tibbitts et al. | 175/374 |
| 7,485,343 | B1 | 2/2009 | Branson et al. | |
| 2006/0029808 | A1 | 2/2006 | Zhai et al. | |
| 2007/0210349 | A1 * | 9/2007 | Lu et al. | 257/252 |
| 2009/0242036 | A1 * | 10/2009 | Kolodner et al. | 137/13 |
| 2010/0108393 | A1 | 5/2010 | John et al. | |
| 2010/0143620 | A1 * | 6/2010 | Ajdelsztajn et al. | 428/34.5 |
| 2010/0282680 | A1 | 11/2010 | Su et al. | |
| 2010/0330340 | A1 | 12/2010 | Rothstein et al. | |
| 2011/0272896 | A1 * | 11/2011 | Kamibayashiyama et al. | 277/650 |
| 2012/0100366 | A1 | 4/2012 | Dumm et al. | |

FOREIGN PATENT DOCUMENTS

WO 2004090065 A1 10/2004

OTHER PUBLICATIONS

International Search Report for International Application No. PCT/US2012/036906 dated Nov. 16, 2012, 3 pages.
International Written Opinion for International Application No. PCT/US2012/036906 dated Nov. 16, 2012, 4 pages.
Agbenyega, Jonathan, Bubbling Up Water Repellence, Materials Today, vol. 13, No. 4. (Apr. 2010), pp. 1-1.
ASTM Standard D7334-08 (Standard Practice for Surface Wettability of Coatings, Substrates and Pigments by Advancing Contact Angle Measurement, ASTM Int'l, West Conshohocken, PA, 2008.
Checco, Antonio et al., Morphology of Air Nanobubbles Trapped at Hydrophobic Nanopatterned Surfaces, 10 NANO Letters 1354-58 (2010).

(Continued)

*Primary Examiner* — Giovanna Wright
(74) *Attorney, Agent, or Firm* — TraskBritt

(57) ABSTRACT

Wellbore tools include a body and a superhydrophobic surface disposed over at least a portion of the body. The superhydrophobic surface includes a patterned surface of a hydrophobic material exhibiting a higher hydrophobicity than an unpatterned surface of the hydrophobic material. A wellbore tool may include a seal, at least one sensor, and at least one flow line, each having at least one superhydrophobic surface. Methods of forming wellbore tools include forming a body, forming a hydrophobic surface over at least a portion of the body, and forming a pattern in a surface of the body, such that the patterned surface exhibits a higher hydrophobicity than an unpatterned surface of the same material.

26 Claims, 6 Drawing Sheets

(56) References Cited

OTHER PUBLICATIONS

Dawnay, E.J.C. et al., Growth and Characterization of Semiconductor Nanoparticles in Porous Sol-Gel Films, J. Mater. Res., vol. 12, No. 11, Nov. 1997, pp. 3115-3126.

Sun, Manhui et al., Artificial Lotus Leaf by Nanocasting, 21 Langmuir 8978-81 (2005).

Tsuchiya, Shin et al., Structural Fabrication Using Cesium Chloride Island Arrays as a Resist in a Fluorocarbon Reactive Ion Etching Plasma, 3 Electrochemical and Solid-State Letters, 44-46 (2000).

* cited by examiner

WELLBORE TOOLS HAVING SUPERHYDROPHOBIC SURFACES, COMPONENTS OF SUCH TOOLS, AND RELATED METHODS

FIELD

Embodiments of the present disclosure relate to tools used within wellbores, to components of such tools, and to methods of making and using such tools.

BACKGROUND

Wellbores are formed in subterranean formations for various purposes including, for example, extraction of oil and gas from the subterranean formation and extraction of geothermal heat from the subterranean formation. Wellbores may be formed in a subterranean formation using a drill bit such as, for example, an earth-boring rotary drill bit. Different types of earth-boring rotary drill bits are known in the art including, for example, fixed-cutter bits (which are often referred to in the art as "drag" bits), rolling-cutter bits (which are often referred to in the art as "rock" bits), diamond-impregnated bits, and hybrid bits (which may include, for example, both fixed cutters and rolling cutters). The drill bit is rotated and advanced into the subterranean formation. As the drill bit rotates, the cutters or abrasive structures thereof cut, crush, shear, and/or abrade away the formation material to form the wellbore. A diameter of the wellbore drilled by the drill bit may be defined by the cutting structures disposed at the largest outer diameter of the drill bit.

The drill bit is coupled, either directly or indirectly, to an end of what is referred to in the art as a "drill string," which comprises a series of elongated tubular segments connected end-to-end that extends into the wellbore from the surface of the formation. Various tools and components, including the drill bit, may be coupled together at the distal end of the drill string at the bottom of the wellbore being drilled. This assembly of tools and components is referred to in the art as a "bottom hole assembly" (BHA).

The drill bit may be rotated within the wellbore by rotating the drill string from the surface of the formation, or the drill bit may be rotated by coupling the drill bit to a downhole motor, which is also coupled to the drill string and disposed proximate the bottom of the wellbore. The downhole motor may comprise, for example, a hydraulic Moineau-type motor having a shaft, to which the drill bit is mounted, that may be caused to rotate by pumping fluid (e.g., drilling mud or fluid) from the surface of the formation down through the center of the drill string, through the hydraulic motor, out from nozzles in the drill bit, and back up to the surface of the formation through the annular space between the outer surface of the drill string and the exposed surface of the formation within the wellbore.

The bodies of downhole tools, such as drill bits and reamers, are often provided with fluid courses, such as "junk slots," to allow drilling mud (which may include drilling fluid and formation cuttings generated by the tools that are entrained within the fluid) to pass upwardly around the bodies of the tools into the annular space within the wellbore above the tools outside the drill string. Drilling tools used for casing and liner drilling usually have smaller fluid courses and are particularly prone to balling, which results in a lower rate of penetration.

When drilling a wellbore, the formation cuttings may adhere to, or "ball" on, the surface of the drill bit. The cuttings may accumulate on the cutting elements and the surfaces of the drill bit or other tool, and may collect in any void, gap, recess, or crevice between the various components of the bit. This phenomenon is particularly enhanced in formations that fail plastically, such as in certain shales, mudstones, siltstones, limestones and other relatively ductile formations. The cuttings from such formations may become mechanically packed in the voids, gaps, recesses, or crevices on the drill bit. In other cases, such as when drilling certain shale formations, the adhesion between formation cuttings and a surface of a drill bit or other tool may be at least partially based on chemical bonds therebetween. When a surface of a drill bit becomes wet with water in such formations, the bit surface and clay layers of the shale may share common electrons. A similar sharing of electrons is present between the individual sheets of the shale itself. A result of this sharing of electrons is an adhesive-type bond between the shale and the bit surface. Adhesion between the formation cuttings and the bit surface may also occur when the charge of the bit face is opposite the charge of the formation. The oppositely charged formation particles may adhere to the surface of the bit. Moreover, particles of the formation may be compacted onto surfaces of the bit or mechanically bonded into pits or trenches etched into the bit by erosion and abrasion during the drilling process.

In some cases, drilling operations are conducted with reduced or mitigated hydraulics, which tend to result in the aforementioned balling problems. For example, some drilling rigs may not have pumps with sufficient capacity to provide desirable pressures and flow rates of drilling fluid for drilling to the depths required. Furthermore, operators sometimes find it too costly to run higher mud flow rates or find that high flow rates cause unacceptable wear and erosion of the BHA.

Attempts have been made to reduce the likelihood of balling in downhole tools, as disclosed in, for example, U.S. Pat. No. 5,651,420, which issued Jul. 29, 1997, to Tibbitts et al., U.S. Pat. No. 6,260,636, which issued Jul. 17, 2001, to Cooley et al.; and U.S. Pat. No. 6,450,271, which issued Sep. 17, 2002, to Tibbitts et al.

Furthermore, materials such as formation cuttings or water droplets may contaminate surfaces of sensors, leading to measurement errors, corrosion, etc.

BRIEF SUMMARY

In some embodiments, the present disclosure includes a wellbore tool including a body and a superhydrophobic surface disposed over at least a portion of the body. The superhydrophobic surface includes a patterned surface of a hydrophobic material exhibiting a higher hydrophobicity than an unpatterned surface of the hydrophobic material.

In other embodiments, a wellbore tool may include a seal having at least one superhydrophobic surface, at least one sensor having at least one superhydrophobic surface, and at least one flow line having at least one superhydrophobic surface. The superhydrophobic surfaces each may comprise a patterned surface of a material having a higher contact angle with water than an unpatterned surface of the same material.

The disclosure includes a method of forming a wellbore tool. The method includes forming a body, forming a hydrophobic surface over at least a portion of the body, and forming a pattern in a surface of the body, such that the patterned surface exhibits a higher hydrophobicity than an unpatterned surface of the same material.

BRIEF DESCRIPTION OF THE DRAWINGS

While the specification concludes with claims particularly pointing out and distinctly claiming what are regarded as embodiments of the disclosure, various features and advantages of this disclosure may be more readily ascertained from the following description of example embodiments provided with reference to the accompanying drawings, in which:

DETAILED DESCRIPTION

Figure 1A:
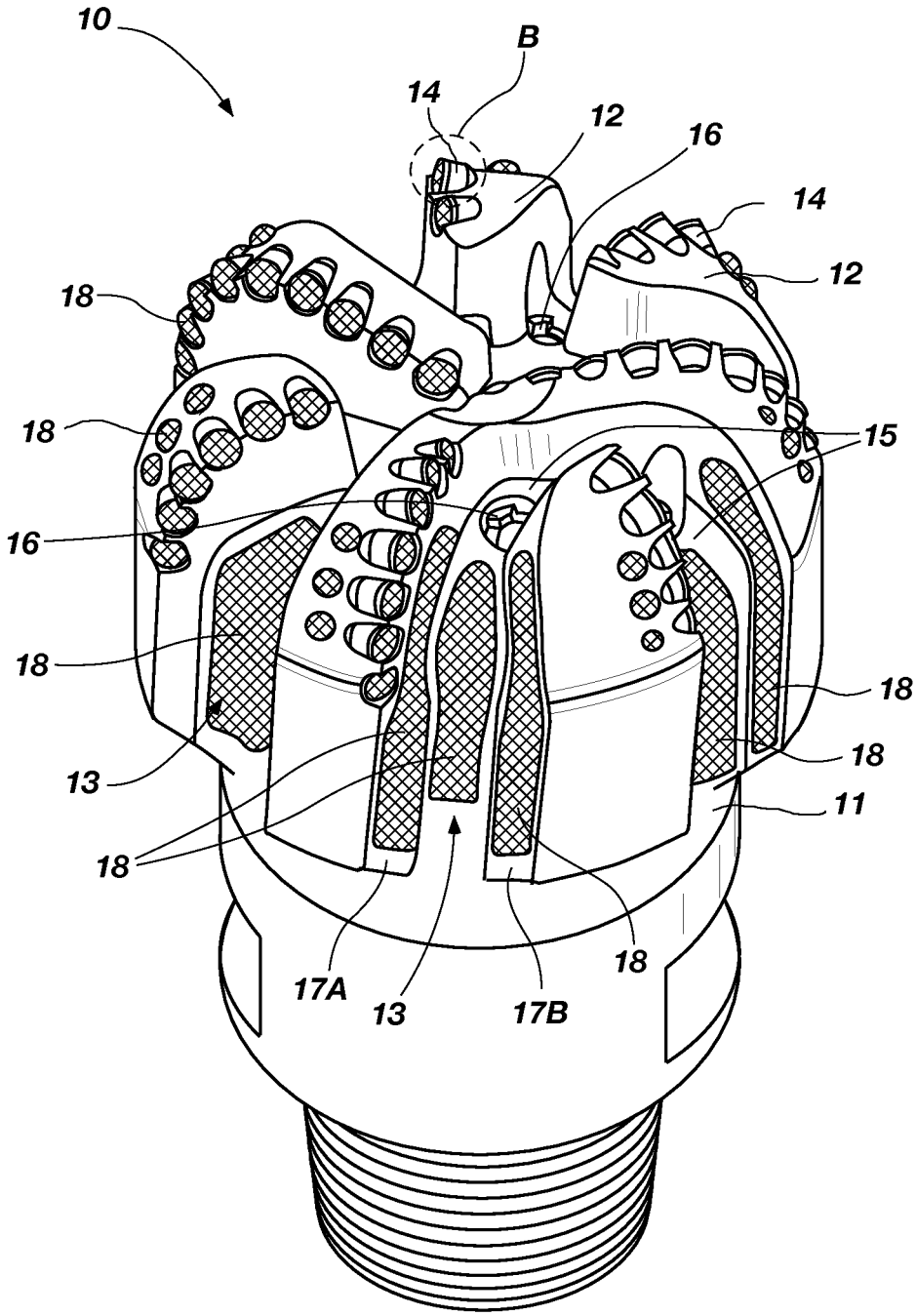
FIG. 1A is a perspective view of an embodiment of an earth-boring tool of the present invention comprising a rotary fixed-cutter drill bit that includes a superhydrophobic surface.

The illustrations presented herein are not actual views of any particular earth-boring tool, drill bit, or component of such a tool or bit, but are merely idealized representations that are employed to describe embodiments of the present disclosure.

As used herein, the term "wellbore tool" means and includes any tool used within a wellbore in a subterranean formation. Wellbore tools include earth-boring tools, sensors, drill strings, pumps, etc.

As used herein, the term "earth-boring tool" means and includes any tool used to remove formation material and form a bore (e.g., a wellbore) through a formation by way of the removal of a portion of the formation material. Earth-boring tools include, for example, rotary drill bits (e.g., fixed-cutter or "drag" bits and roller cone or "rock" bits), hybrid bits including both fixed cutters and roller elements, coring bits, percussion bits, bi-center bits, casing mills and drill bits, exit tools, reamers (including expandable reamers and fixed-wing reamers), and other so-called "hole-opening" tools.

As used herein, the term "cutting element" means and includes any element of an earth-boring tool that is used to cut or otherwise disintegrate formation material when the earth-boring tool is used to form or enlarge a bore in the formation.

As used herein, the term "sensor" means and includes a device that responds to a physical condition and transmits a signal as a function of that condition. For example, sensors may be configured to detect pressures, flow rates, temperatures, etc., and may be configured to communicate with other parts of a drill string (e.g., a control system).

As used herein, the term "hydrophobic" means and includes any material or surface with which water droplets have a contact angle in air of at least 90°, as measured by a contact angle goniometer as described in ASTM Standard D7334-08 (Standard Practice for Surface Wettability of Coatings, Substrates and Pigments by Advancing Contact Angle Measurement, ASTM Int'l, West Conshohocken, Pa., 2008), which standard is incorporated herein in its entirety by this reference. Hydrophobic materials include, for example, nonpolar silicones and fluorocarbons.

As used herein, the term "superhydrophobic" means and includes any surface with which water droplets have a contact angle in air of at least 150°, as measured by a contact angle goniometer as described in ASTM Standard D7334-08. Bulk materials are not normally superhydrophobic, but a surface of a hydrophobic material may be superhydrophobic if it includes a three-dimensional pattern.

As used herein, the term "nanoscale pattern" means and includes a three-dimensional topography of features (e.g., ridges, troughs, pits, mounds, etc.) having at least one dimension of about 1 micron or less. A nanoscale pattern may be disposed on an otherwise flat surface or on a surface having an underlying curvature or features larger than the features of the nanoscale pattern. As used herein, the term "microscale pattern" means and includes a three-dimensional topography of features (e.g., ridges, troughs, pits, mounds, etc.) having at least one dimension of about 1 mm or less.

Certain surfaces formed over wellbore tools may decrease the adhesion of drilling mud, formation cuttings, and other materials to those wellbore tools. Such surfaces may include, for example, patterned surfaces of hydrophobic materials, surfaces which may be superhydrophobic and may exhibit a higher hydrophobicity than an unpatterned surface of the hydrophobic material.

In some embodiments, the disclosure includes a wellbore tool including a body, a hydrophobic material, and a patterned surface on and/or in the hydrophobic material. The body may include, for example, a bit body configured to retain at least one cutting element. In certain embodiments, the body may include a sensor, such as a sensor configured to be attached to an earth-boring tool. The body may include a hydrophobic material or any material to which a hydrophobic material may be attached, such as nonmetallic inorganic surfaces, metals, polymers, etc.

FIG. 1A illustrates an embodiment of a wellbore tool of the present disclosure. The wellbore tool shown in FIG. 1A is an earth-boring rotary drill bit 10 having a bit body 11 that includes a plurality of blades 12 separated from one another by fluid courses 13. The portions of the fluid courses 13 that extend along the radial sides (the "gage" areas of the drill bit 10) between adjacent blades 12 are often referred to in the art as "junk slots." A plurality of cutting elements 14 are mounted to each of the blades 12. The bit body 11 further includes a generally cylindrical internal fluid plenum and fluid passageways that extend through the bit body 11 to an exterior surface 15 of the bit body 11. Nozzles 16 may be secured within the fluid passageways proximate the exterior surface 15 of the bit body 11 for controlling the hydraulics of the drill bit 10 during drilling.

During a drilling operation, the drill bit 10 may be coupled to a drill string (not shown). As the drill bit 10 is rotated within the wellbore, drilling fluid may be pumped down the drill string, through the internal fluid plenum and fluid passageways within the bit body 11 of the drill bit 10, and out from the drill bit 10 through the nozzles 16. Formation cuttings generated by the cutting elements 14 of the drill bit 10 may be carried with the drilling fluid through the fluid courses 13, around the drill bit 10, and back up the wellbore through an annular space within the wellbore and outside the drill string.

As shown in FIG. 1A, a hydrophobic material 18, which is represented in FIG. 1A by the cross-hatched areas for purposes of illustration, may be disposed over at least a portion of the exterior surface 15 of the bit body 11. The hydrophobic material 18 may have a composition selected to reduce accumulation of formation cuttings thereon when the drill bit 10 is used to form a wellbore, or to reduce interaction (e.g., friction) between the drill bit 10 and the subterranean formation. The hydrophobic material 18 may have a patterned surface to increase its hydrophobicity (i.e., to make the surface superhydrophobic). The hydrophobic material 18 may be provided at, for example, regions of the drill bit 10 susceptible to balling or over which fluid flows, such as pinch points (e.g., locations at which blades converge), cuttings trajectory points (e.g., locations at which cuttings converge), the bit shank (i.e., where the bit head and threaded pin meet), surfaces of cutting elements 14, and/or surfaces of nozzles 16. For example, the hydrophobic material 18 may be disposed over one or more regions of the exterior surface 15 of the bit body 11 of the drill bit 10 within the fluid courses 13, as shown in FIG. 1A. Such regions may include, for example, rotationally leading surfaces 17A of the blades 12, rotationally trailing surfaces 17B of the blades 12, under the cutting elements 14 where chip flow occurs, and behind the cutting elements 14. In additional embodiments, the hydrophobic material 18 may form a generally continuous coating disposed over at least substantially all exterior surfaces of the bit body 11 of the drill bit 10.

Figure 1B:
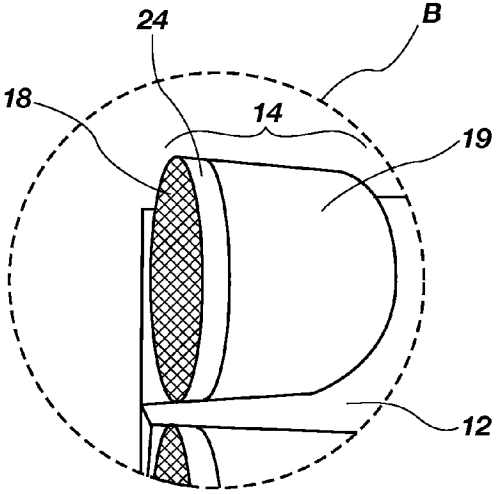
FIG. 1B is an inset view of a portion of the earth-boring tool of FIG. 1A.

FIG. 1B shows detail of a cutting element 14, in the area of FIG. 1A enclosed by dotted circle B. The cutting element 14 may include a substrate 19 (e.g., a tungsten carbide substrate), a hard polycrystalline material 24 (e.g., a diamond table etc.), and a hydrophobic material 18. The hydrophobic material 18 may have a patterned surface to increase its hydrophobicity (e.g., to make the surface superhydrophobic).

Figure 2:
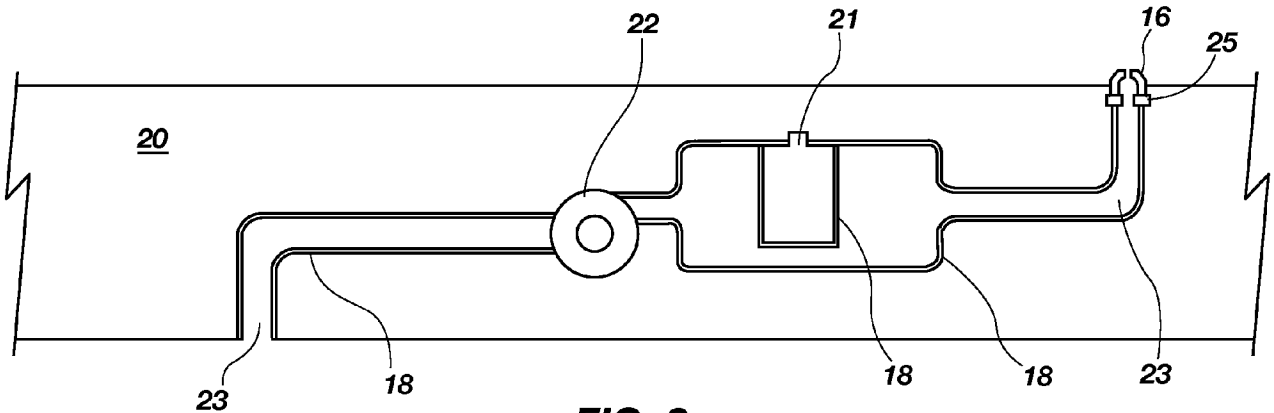
FIG. 2 is a cross-sectional view of an embodiment of an earth-boring tool of the present invention that includes a sensor and flow line including superhydrophobic surfaces.

FIG. 2 illustrates an embodiment of a wellbore tool 20 including a sensor. The sensor may include a sensor body 21, shown in FIG. 2 as an acoustic transceiver. The sensor body may include, for example, a tuning fork. The sensor body 21 may include any structure known in the art for sensors. The sensor includes a hydrophobic material 18 disposed over at least a portion of the sensor body 21. The hydrophobic material 18 may have a patterned surface to increase its hydrophobicity (e.g., to make the surface superhydrophobic). For example, the hydrophobic material 18 may substantially cover the sensor body 21. The sensor may include, for example, sensors for detecting gas concentrations, viscosities, densities, etc. The sensor may include electrical, mechanical, optical, or other connectors (not shown) for communicating with components of a drill string or control system. For example, the sensor may communicate to a pump 22 through which drilling mud is pumped downhole. The pump 22 may adjust its output based on a signal from the sensor, such as to maintain constant fluid flow through a nozzle 16.

In some embodiments, a wellbore tool 20 may include a flow line 23 (e.g., a tube or pipe). The sensor may be in fluid communication with portions of a drill string (e.g., pump 22 and nozzle 16) via one or more flow lines 23. Flow lines 23 may include one or more surfaces of a hydrophobic material 18, which surfaces may be patterned to increase the hydrophobicity of the interior surfaces within the flow lines 23, through which drilling mud may pass.

In some embodiments, a body of a wellbore tool may include a seal 25. For example, seals 25 may include elastomeric gaskets, O-rings, washers, etc. Such seals 25 may be disposed between portions of the wellbore tool 20, such as between a nozzle 16 and a flow line 23. Seals 25 may have surfaces including a hydrophobic material 18 having a pattern.

The hydrophobic material 18 may include any material that has a contact angle θ with water of greater than 90°. The hydrophobic material 18 may be a coating over another material comprising the body (e.g., the bit body 11 shown in FIG. 1A or the sensor body 21, flow lines 23, or seal 25, shown in FIG. 2) or may itself form at least a portion of the body as a bulk material.

Figure 3:
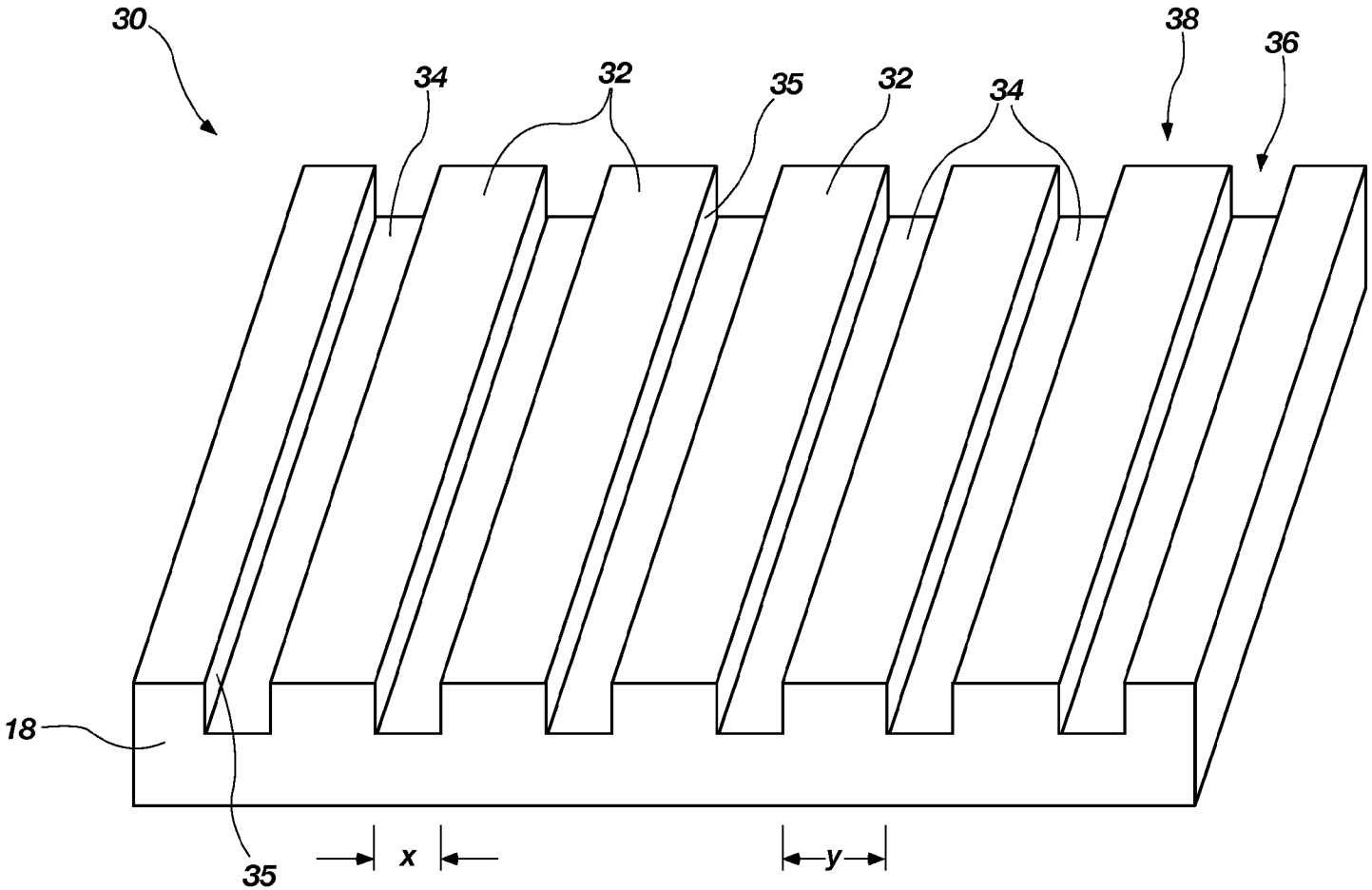
FIGS. 3 through 5 are perspective views of superhydrophobic surfaces.

The hydrophobic material 18 over the body may include a patterned surface, such as a nanoscale and/or microscale pattern or arrangement of recesses. Such a patterned surface may impart superhydrophobic properties to a hydrophobic material. As shown in FIG. 3, a first region 32 of a pattern 30 (e.g., a nanoscale and/or microscale pattern) may include a plurality of ridges 38, and a second region 34 of a pattern 30 may include a plurality of troughs 36. The ridges 38 may separate adjacent troughs 36, and the troughs 36 may separate adjacent ridges 38. The first region 32 may be at a first elevation relative to the underlying body, and the second region 34 may be at a different, second elevation. The second elevation may be higher or lower than the first elevation. For example, the second elevation may be within about 500 nm of the first elevation (e.g., 500 nm lower than the first elevation), within about 200 nm of the first elevation, or within about 100 nm of the first elevation.

The pattern 30 may include features having at least one lateral dimension of about 100 microns or less (e.g., ridges 38 or troughs 36 having cross-sectional widths of about 100 microns or less). For example, as shown in FIG. 3, a distance x between adjacent ridges 38 may be about 50 microns or less, about 5 microns or less, about 500 nm or less, about 100 nm or less, or even about 50 nm or less. In some embodiments, the distance x between adjacent ridges 38 may be about 20 nm. Furthermore, as shown in FIG. 3, a distance y between adjacent troughs 36 may be about 50 microns or less, about 5 microns or less, about 500 nm or less, about 100 nm or less, or even about 50 nm or less. In some embodiments, the distance y between adjacent troughs 36 may be about 20 nm. As shown in FIG. 3, the distance x between adjacent ridges 38 may be less than the distance y between adjacent troughs 36. In other embodiments, the distance x between adjacent ridges 38 may be greater than or equal to the distance y between adjacent troughs 36. When the surface of the pattern 30 comprises a hydrophobic material, the pattern 30 may exhibit superhydrophobic properties.

The first region 32 and the second region 34 of the pattern 30 may be defined by approximately linear (i.e., straight) edges, and sidewalls 35 of the pattern 30 may be substantially vertical. In other embodiments, the edges of the first region 32 and the second region 34 of the pattern 30 may be defined by curved edges. In yet further embodiments, the sidewalls 35 of the pattern 30 may be non-vertical and/or curved.

Figure 4:
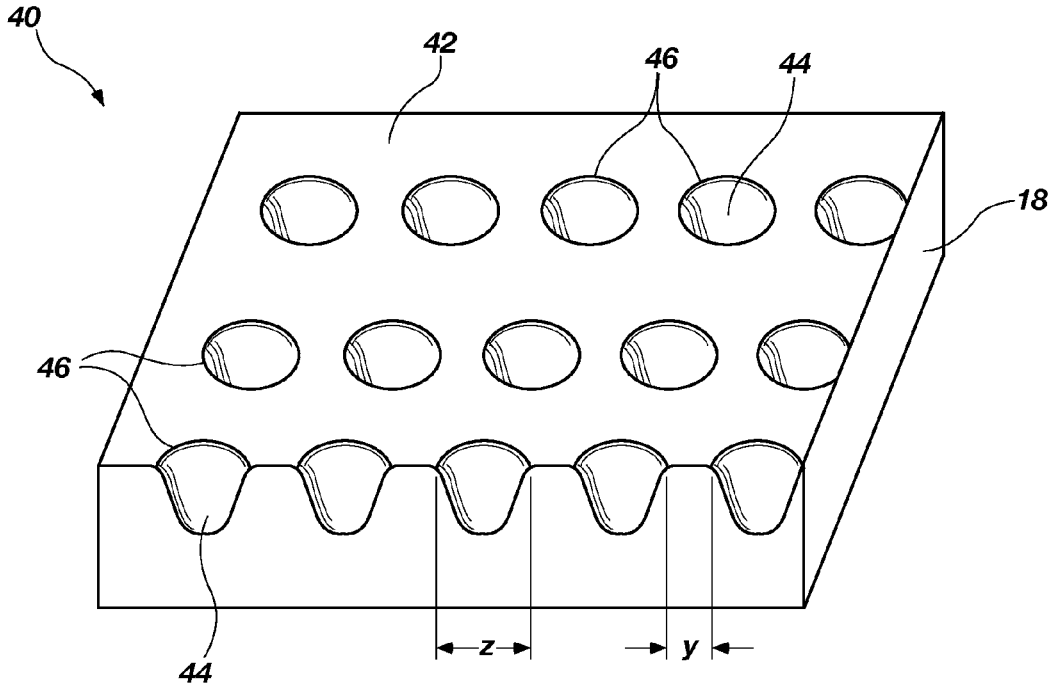

FIG. 4 illustrates another pattern 40 of the disclosure. The pattern 40 may include a first region 42 that is continuous, and a second region 44 including a plurality of pits 46. The plurality of pits 46 may be arranged in an ordered pattern, as shown in FIG. 4, or may have a random arrangement. The pits 46 may be of uniform depth, as shown, or different pits 46 may have different depths. When the surface of the pattern 40 comprises a hydrophobic material, the pattern 40 may exhibit superhydrophobic properties.

Figure 5:
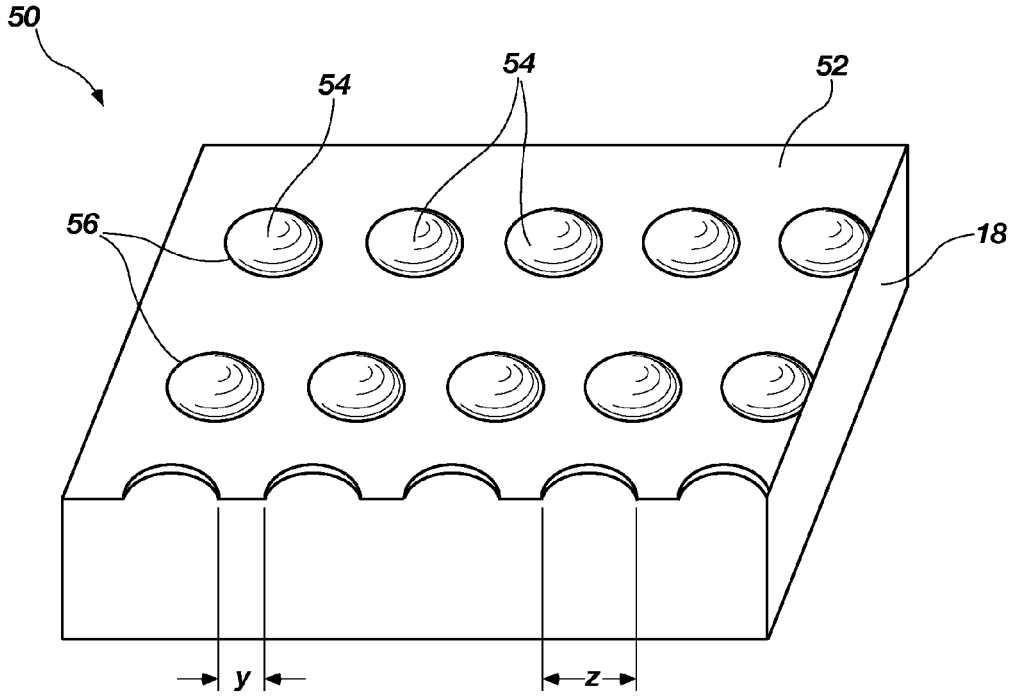

FIG. 5 illustrates another pattern 50 of the disclosure. The pattern 50 may include a first region 52 that is continuous, and a second region 54 including a plurality of elevated mounds 56, which may also be characterized as bumps or as protrusions. The plurality of mounds 56 may be arranged in an ordered pattern, as shown in FIG. 5, or may have a random arrangement. The height of mounds 56 may be uniform or variable. When the surface of the pattern 50 comprises a hydrophobic material, the pattern 40 may exhibit superhydrophobic properties.

In the patterns 40, 50 shown in FIGS. 4 and 5, the first regions 42, 52 may be at a first elevation relative to an underlying body, and the second regions 44, 54 may be at a different, second elevation. The second elevation may be higher (FIG. 5) or lower (FIG. 4) than the first elevation (i.e., a level of the second region 44, 54 may be above or below a level of the first region 42, 52 with respect to the body over which the hydrophobic material 18 is disposed). For example, the second elevation may be within about 50 microns of the first elevation (e.g., 500 nm lower than the first elevation), within about 5 microns of the first elevation, within about 500 nm of the first elevation, within about 200 nm of the first elevation, or within about 100 nm of the first elevation.

The pattern 40, 50 may include features having at least one lateral dimension of about 100 microns or less. For example, a distance y between adjacent second regions 44, 54 at similar elevations may be about 50 microns or less, about 5 microns or less, about 500 nm or less, about 100 nm or less, or even about 50 nm or less. In some embodiments, the distance y between adjacent second regions 44, 54 may be about 20 nm. In further examples, second regions 44, 54 may have a lateral dimension (e.g., a diameter z or a width) of about 100 microns or less. For example, pits 46 or mounds 56 may have a lateral dimension of about 50 microns or less, about 5 microns or less, about 500 nm or less, about 100 nm or less, or even about 50 nm or less. In some embodiments, the lateral dimension may be about 20 nm. Though shown as having approximately rounded profiles in FIGS. 4 and 5, the pits 46 or mounds 56 may have any shape. For example, pits 46 or mounds 56 have shapes approximately conical, parabolic, cylindrical, cubic, etc. The pits 46 or mounds 56 may all have the same lateral dimensions, or may have different lateral dimensions.

Furthermore, any of the features shown in FIGS. 3 through 5 may be combined into a single pattern. For example, a pattern may include pits 46 and mounds 56; troughs 36 and pits 46; or troughs 36, pits 46, and mounds 56. Any other nanoscale and/or microscale pattern that will render a hydrophobic surface superhydrophobic may also be used.

Figure 6:
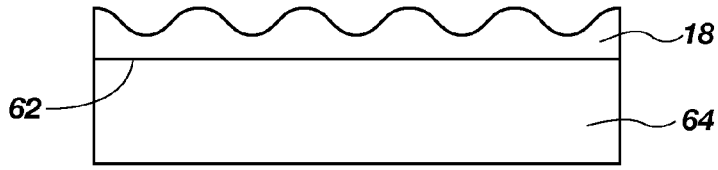
FIGS. 6 through 10 are cross-sectional views of components including superhydrophobic surfaces.

As shown in the cross-sectional view of FIG. 6, the hydrophobic material 18 may have a surface 62 in contact with a body 64 (e.g., a bit body 11 or a sensor housing 21, as shown in FIGS. 1A and 2, respectively). The hydrophobic material 18 may include a patterned surface as described above. The surface 62 in contact with the body 64 may be substantially planar or may have features with a lateral dimension much larger than a lateral dimension of features of the patterned surface, such that the surface 64 appears flat upon magnification sufficient to discern the pattern of the hydrophobic material 18. For example, the surface 62 may have features three or more orders of magnitude larger than features of the patterned surface (e.g., about 1 mm). As shown in FIG. 6, the thickness of the hydrophobic material 18 may vary, and the thickness may be complementary to the contours of the patterned surface.

Figure 7:
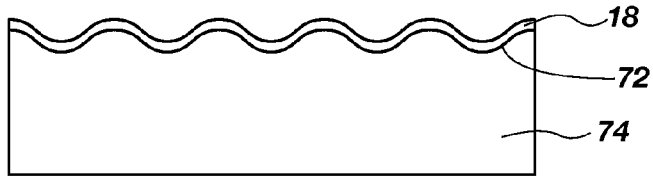

As shown in FIG. 7, the hydrophobic material 18 may have a nonplanar surface 72 in contact with a body 74 (e.g., a bit body 11 or a sensor housing 21, as shown in FIGS. 1A and 2, respectively) having a lateral dimension similar to the lateral dimension of the patterned surface. For example, the hydrophobic material may have a substantially uniform thickness, and the contours of the patterned surface may be complementary to contours of the surface of the body 74 (i.e., the features of the patterned surface may be of approximately the same height and lateral dimension as features of the body 74).

Figure 8:
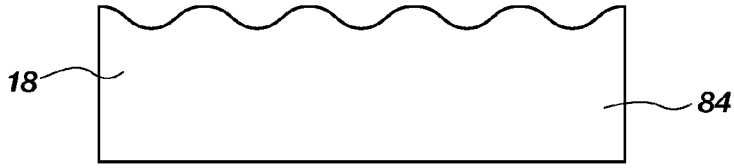

As shown in FIG. 8, a body 84 (e.g., a bit body 11 or a sensor housing 21, as shown in FIGS. 1A and 2, respectively) may be formed of the hydrophobic material 18. In such embodiments, the patterned surface is formed in and/or on the body 84 rather than in and/or on a material overlying the body.

Figure 9:
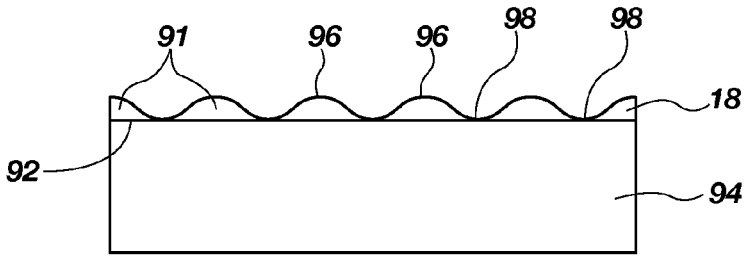

As shown in FIG. 9, the hydrophobic material 18 may be or comprise a plurality of discontinuous regions 91 over a body 94 (e.g., a bit body 11 or a sensor housing 21, as shown in FIGS. 1A and 2, respectively). In other words, the hydrophobic material 18 may include a first region 96 of a patterned surface at a first elevation, whereas the body 94 includes a second region 98 of the patterned surface at a second elevation. A surface 92 of the hydrophobic material 18 in contact with the body 94 may be substantially planar, or may be nonplanar with features having a lateral dimension much larger than a lateral dimension of features of the patterned surface.

Figure 10:
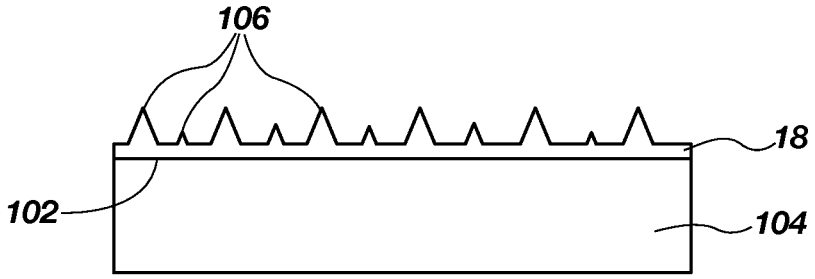

Though the features are shown in FIGS. 3 through 9 as having uniform dimensions across the hydrophobic material 18, the height, lateral dimension, or spacing of features may vary across a single surface. For example, FIG. 10 shows a hydrophobic material 18 having a surface 102 in contact with a body 104 (e.g., a bit body 11 or a sensor body 21, as shown in FIGS. 1A and 2, respectively). The hydrophobic material 18 shown in FIG. 10 has a profile with triangular surface features 106. The triangular surface features 106 may be of various heights and widths, as shown in FIG. 10, or may be of uniform size. The spacing between triangular surface features 106 may be uniform or nonuniform.

Furthermore, though FIGS. 6 through 9 show approximately sinusoidal cross-sections of patterned surfaces, and FIG. 10 shows triangular features in its cross-section, the cross-sections of patterned surfaces may have any shape, as dictated by particular applications and/or patterning methods. For example, the cross-section of the patterned surface may include square corners (e.g., as shown in FIG. 3), circular arcs, parabolic sections, etc. Furthermore, since the patterned surface is a three-dimensional feature, the cross-section along one axis may or may not exhibit the same shape as the cross-section along another axis. For example, a cross-section along one axis may be approximately sinusoidal, as shown in FIGS. 6 through 9, and a cross-section along an axis perpendicular thereto may include square corners.

Due to surface tension, water droplets tend to form a shape that minimizes their surface areas, (i.e., spheres, in the absence of any other surfaces). When in contact with a solid, a water droplet shares a portion of its surface with a surface of the solid, and with surrounding gas. The area of the surface in common between the solid and the water droplet may depend on the interactions between water molecules and the molecules of the solid. Solids that are hydrophobic form a contact angle with water droplets of greater than 90°. See ASTM Standard D7334-08 (Standard Practice for Surface Wettability of Coatings, Substrates and Pigments by Advancing Contact Angle Measurement, ASTM Int'l, West Conshohocken, Pa., 2008).

A patterned surface may amplify the hydrophilic or hydrophobic nature of a material. In other words, a patterned surface of a hydrophobic material may form a larger contact angle with water droplets than a flat surface of the same hydrophobic material (i.e., a flat surface comprising a chemical composition identical to the patterned surface). Similarly, a patterned surface of a hydrophilic material may form a smaller contact angle with water droplets than a flat surface of the same hydrophilic material. Nanoscale air bubbles may become trapped between water droplets and cavities of a hydrophobic patterned surface, decreasing the contact surface area between the droplets and the hydrophobic material. Such a theory is described in Antonio Checco et al., *Morphology of Air Nanobubbles Trapped at Hydrophobic Nanopatterned Surfaces,* 10 Nano Letters 1354-58 (2010), which document is incorporated herein by reference in its entirety. Without being bound to a particular theory, it is believed that this lower contact surface area may contribute to superhydrophobic properties of hydrophobic patterned materials. In other words, repulsive forces between water droplets and hydrophobic patterned surfaces may be stronger than repulsive forces between water droplets and flat surfaces of the same material. Stronger repulsive forces may help water droplets to roll off the surfaces, giving patterned hydrophobic surfaces a self-cleaning property (which may be referred to as the "Lotus effect").

In some embodiments, the disclosure includes methods of forming wellbore tools. The methods may include forming a body, forming a hydrophobic surface over at least a portion of the body, and forming a pattern in a surface of the body. The patterned surface may have a higher hydrophobicity than an unpatterned surface of the same material.

The body may be formed using methods known in the art. Hydrophobic surfaces may be formed by conventional means known in the art. Hydrophobic surfaces may be formed over an approximately flat portion of the body or over a textured surface. In other words, the hydrophobic surface may be formed over an unpatterned body, or over a patterned surface of a body.

A pattern may be formed in the surface of the body by a variety of means, such as by methods similar to those described in Antonio Checco et al., *Morphology of Air Nanobubbles Trapped at Hydrophobic Nanopatterned Surfaces,* 10 Nano Letters 1354-58 (2010), previously incorporated herein by reference. For example, a block copolymer thin film may be prepared over a surface of a body, and may have nanometer-scale features (i.e., less than 20 nm). A plasma etch may remove portions of the surface of the body not masked by the block copolymer. The block copolymer thin film may be removed from the substrate by another plasma etch (e.g., an $O_2$ plasma etch) to form a substrate having hexagonally packed nanocavities. The body may be coated with a hydrophobic material (e.g., a monolayer of hydrophobic material) to impart superhydrophobic properties to the surface.

Plasma etching may be performed with various etchants, and suitable plasma etchants may depend on the material to be etched. For example, bodies comprising polymers may be etched with a $CF_4$ plasma and a suitable resist. Bodies comprising silicon-containing compounds may be etched with $SF_6$-based or HBr-based plasmas. Bodies comprising certain metals (e.g., copper) may be etched with a $CCl_4$ plasma and a resist. Bodies comprising other metals or materials may be etched with different plasma etchants. In some embodiments, a chemical etch may remove portions of the surface not masked. For example, an acid may be used to etch metallic surfaces, or vapor phase xenon difluoride ($XeF_2$) may be used to etch silicon surfaces.

In some embodiments, a pattern may be formed by nanoscale lithography, such as described in Shin Tsuchiya et al., *Structural Fabrication Using Cesium Chloride Island Arrays as a Resist in a Fluorocarbon Reactive Ion Etching Plasma,* 3 Electrochemical and Solid-State Letters, 44-46 (2000), which document is incorporated herein in its entirety by this reference. For example, cesium chloride may be deposited in a thin layer over a hydrophilic surface. The cesium chloride may self-assemble in distinct hemispheres having mean diameters from about 30 nm to about 1200 nm (1.2 microns) on the surface, exposing portions of the surface between the hemispheres. The hydrophilic surface may be etched to remove portions not covered by the cesium chloride, and may expose portions of an underlying hydrophobic surface. A pattern formed by this method may be coated with a hydrophobic material. Other materials that self-assemble in patterns may also be used. Patterns may be transferred or formed on a substrate by etching or patterning, sand blasting, and/or water jetting, wherein the self-assembled pattern acts a stencil.

In other embodiments, patterns may be formed by drying a derivatized silica sol to form a hydrophobic fractal surface, such as by methods described in Preparation of Hydrophobic Coatings, U.S. Pat. No. 7,485,343, issued Feb. 3, 2009, the disclosure of which is incorporated herein in its entirety by this reference.

In some embodiments, a hydrophobic material may be formed on (e.g., deposited on) the surface as the pattern is formed. For example, a hydrophobic surface may be formed as a surface of the body is patterned by using a fluorinated compound as the etchant to pattern the surface. The hydrophobic surface formed may be continuous, as shown in FIG. 7, or discontinuous, as shown in FIG. 9. The hydrophobic surface formed may include, for example, polytetrafluoroethylene or another fluorinated compound.

Patterned surfaces may be formed using laser irradiation. For example, as known in the art and not described in detail herein, laser ablation techniques may be used to selectively remove material from a surface. In other embodiments, a material (e.g., a resin) may be spread over a portion of a body, and laser irradiation may selectively cure portions of the material. Uncured material may be removed, leaving a patterned surface of cured material on the body.

In certain embodiments, the patterned surface may be a porous material. That is, a hydrophobic material may be formed over porous surface of material, such as a material having microscale or nanoscale pores. The porous material may or may not be further patterned.

In some embodiments, a pattern may be formed in a surface of a hydrophobic material. That is, a hydrophobic material may be formed over a portion of a body. A surface of the hydrophobic material may then be patterned, such as by etching, laser ablation, etc.

Patterned surfaces may be formed by nanocasting, such as by methods described in Manhui Sun et al., *Artificial Lotus Leaf by Nanocasting,* 21 Langmuir 8978-81 (2005), which is incorporated herein by reference in its entirety. For example, a template may be formed having the inverse of a pattern to be formed, such as by casting a mold material against a lotus leaf, by nanoscale lithography, or by laser techniques. A material (e.g., a hydrophobic material or a material to which a hydrophobic material may be applied) may be cast against the template and then cured (e.g., with a catalyst). The template may be removed after the material is cured. The cured material may have a pattern inverse to the pattern of the template, even when the pattern has features of small dimension (e.g., about 20 nm). The cured material may, optionally, be coated with a hydrophobic material. A single template may be used repeatedly to faun multiple patterned surfaces as long as the template is not damaged in the process.

Patterned surfaces may also be formed by other methods. For example, surfaces may be embossed by stencils having a nanoscale and/or microscale pattern. The stencils may be pressed against a substrate to transfer the pattern to the substrate. The stencils and/or the substrate may be heated or otherwise processed to promote the transfer. As another example, a resin or epoxy may be applied to a substrate (e.g., sprayed onto the substrate). Portions of the resin or epoxy may be selectively cured, such as by shining an ultraviolet light through a stencil having a nanoscale and/or microscale pattern. In another example, patterned surfaces may be formed by galvanic pulse plating, in which positive and negative current pulses are applied in a pattern across the surface of a substrate (e.g., a nickel substrate). As yet another example, a galvanic pulse plating process may be used to form a pattern of a nanoscale material, such as graphene, nanotubes, nanofibers, or nanoparticles. The nanoscale material may be applied to a surface, and galvanic pulses may be used to assemble the nanoscale material into islands on the surface.

Patterned surfaces may be foamed in a hierarchical morphology. In other words, a first pattern may be formed over a substrate, and a second pattern may be formed over the first pattern. The second pattern may have a different lateral dimension than the first pattern. For example, the first pattern may have a microscale pattern, and the second pattern may have a nanoscale pattern. In other words, surfaces may be patterned to define a first pattern having at least one microscale dimension, after which those surfaces may be patterned to define a second pattern on the surfaces of the first pattern, the second pattern having at least one nanoscale dimension.

Superhydrophobic surfaces such as those described herein may have reduced surface energy, such that water and other liquids may roll off them more easily relative to other surfaces. Superhydrophobic surfaces may be "self-cleaning," meaning that water rolling off the surfaces may remove other materials therefrom. For example, corrosive materials used in drilling may be removed from earth-boring tools having superhydrophobic surfaces more easily than from tools without such surfaces. Upon removal from a wellbore, tools having superhydrophobic surfaces may be cleaner than tools without such surfaces, and may therefore require less effort to properly clean and store.

Furthermore, superhydrophobic surfaces may be less prone to sticking or balling of formation cuttings. Tools having such surfaces proximate cutting elements may therefore cut more efficiently than other tools. Tools having superhydrophobic surfaces may have lower frictional forces against formation materials, and such tools may require lower pump pressures and flow rates to operate than similar tools without superhydrophobic surfaces. Flow lines having superhydrophobic surfaces may exert lower frictional forces on fluids traveling therethrough (i.e., lower head loss). Therefore, a drill string with such coated flow lines may transmit greater pressure to earth-boring tools connected to the drill string. That is, pressure losses within coated flow lines may be lower than pressure losses in uncoated flow lines. The use of coated flow lines may therefore enable the use of smaller pumps, use of smaller flow lines, or drilling in regions requiring higher pressure. Seals having superhydrophobic surfaces may have a reduced contact area with fluids. This reduced contact area may improve the lifetime of the seals by keeping drilling mud out of crevices (i.e., by helping to keep the seals clean).

The self-cleaning property of superhydrophobic surfaces may be beneficial for surfaces of sensors because materials disposed on sensor surfaces may interfere with proper sensor operation. For example, water droplets or solid particulate matter in contact with surfaces may lead to measurement error. Furthermore, a sensor with superhydrophobic surfaces may have a longer useful life than a similar sensor without superhydrophobic surfaces. Further, a superhydrophobic surface may reduce or avoid deposition or sedimentation on a sensor, preserving the sensor's performance and operational characteristics.

Additional non-limiting example embodiments of the disclosure are described below.

Embodiment 1: A wellbore tool comprising a body and a superhydrophobic surface disposed over at least a portion of the body. The superhydrophobic surface comprises a patterned surface of a hydrophobic material exhibiting a higher hydrophobicity than an unpatterned surface of the hydrophobic material.

Embodiment 2: The wellbore tool of Embodiment 1, wherein the patterned surface comprises a pattern having a first region at a first elevation and a second region at a second elevation, at least one of the first region and the second region having at least one lateral dimension of about 50 microns or less.

Embodiment 3: The wellbore tool of Embodiment 2, wherein at least one of the first region and the second region comprises at least one of a plurality of pits and a plurality of mounds.

Embodiment 4: The wellbore tool of Embodiment 3, wherein the at least one of a plurality of pits and a plurality of mounds comprises at least one of a plurality of pits and a plurality of mounds in an ordered pattern.

Embodiment 5: The wellbore tool of Embodiment 3, wherein the at least one of a plurality of pits and a plurality of mounds comprises at least one of a plurality of pits and a plurality of mounds in a random arrangement.

Embodiment 6: The wellbore tool of any of Embodiments 2 through 5, wherein at least one of the first region and the second region comprises a plurality of recesses.

Embodiment 7: The wellbore tool of any of Embodiments 2 through 6, wherein the first elevation is within about 200 nm of the second elevation.

Embodiment 8: The wellbore tool of any of Embodiments 1 through 7, wherein the body comprises a bit body configured to retain at least one cutting element.

Embodiment 9: The wellbore tool of any of Embodiments 1 through 7, wherein the body comprises a cutting element.

Embodiment 10: The wellbore tool any of Embodiments 1 through 7, wherein the body comprises a seal.

Embodiment 11: The wellbore tool any of Embodiments 1 through 7, wherein the body comprises a sensor.

Embodiment 12: A method of foil ling a wellbore tool comprising forming a body, forming a hydrophobic surface over at least a portion of the body, and forming a pattern in a surface of the body, such that the patterned surface exhibits a higher hydrophobicity than an unpatterned surface comprising an identical chemical composition.

Embodiment 13: The method of Embodiment 12, wherein forming a pattern in a surface of the body comprises forming a pattern having a first region at a first elevation and a second region at a second elevation, at least one of the first region and the second region having at least one lateral dimension of about 50 microns or less.

Embodiment 14: The method of Embodiment 13, wherein forming a pattern comprises forming the first region at the first elevation within about 200 nm of the second elevation.

Embodiment 15: The method of any of Embodiments 12 through 14, wherein forming a pattern comprises selectively exposing the surface of the body to laser irradiation to remove material therefrom.

Embodiment 16: The method of any of Embodiments 12 through 14, wherein forming a pattern comprises selectively exposing the surface of the body to a plasma to remove material therefrom.

Embodiment 17: The method of any of Embodiments 12 through 16, wherein forming a pattern comprises forming at least one of a plurality of pits and a plurality of mounds.

Embodiment 18: The method of Embodiment 17, wherein forming a plurality of pits or mounds comprises forming the at least one of a plurality of pits and a plurality of mounds in an ordered pattern.

Embodiment 19: The method of any of Embodiments 12 through 18, wherein forming a pattern comprises forming a plurality of troughs.

Embodiment 20: The method of any of Embodiments 12 through 19, wherein forming a pattern comprises simultaneously forming the pattern and forming the hydrophobic surface.

Embodiment 21: The method of any of Embodiments 12 through 19, wherein forming a pattern comprises forming a pattern over the hydrophobic surface.

Embodiment 22: The method of any of Embodiments 12 through 19, wherein forming a hydrophobic surface comprises forming a hydrophobic surface over the pattern.

Embodiment 23: The method of any of Embodiments 12 through 19, wherein forming a pattern comprises exposing portions of the body through a stencil.

Embodiment 24: The method of Embodiment 23, wherein exposing portions of the body through a stencil comprises exposing a resin to ultraviolet light.

Embodiment 25: The method any of Embodiments 12 through 19, wherein forming a pattern comprises exposing a portion of the body to galvanic pulse plating.

Embodiment 26: The method of Embodiment 25, wherein galvanic nanotexturing comprises forming a pattern of a nanoscale material over the body.

Embodiment 27: The method of any of Embodiments 12 through 26, wherein forming a pattern comprises forming a first pattern in a surface of the body and forming a second pattern over the first pattern.

Embodiment 28: The method of any of Embodiments 12 through 27, wherein forming a hydrophobic surface comprises forming a first hydrophobic material over a surface of the body and forming a second hydrophobic material over the first hydrophobic material.

Embodiment 29: A wellbore tool comprising a seal having at least one superhydrophobic surface, at least one sensor having at least one superhydrophobic surface, and at least one flow line having at least one superhydrophobic surface. The superhydrophobic surfaces each comprise a patterned surface of a material having a higher contact angle with water than an unpatterned surface of the same material.

Although the foregoing description contains many specifics, these are not to be construed as limiting the scope of the present invention, but merely as providing certain embodiments. Similarly, other embodiments of the invention may be devised which do not depart from the scope of the present invention. For example, features described herein with reference to one embodiment also may be provided in others of the embodiments described herein. The scope of the invention is, therefore, indicated and limited only by the appended claims and their legal equivalents, rather than by the foregoing description. All additions, deletions, and modifications to the invention, as disclosed herein, which fall within the meaning and scope of the claims, are encompassed by the present invention.

What is claimed is:

1. A wellbore tool, comprising:

a bit body comprising a metal and configured to retain at least one cutting element adjacent an outer surface of the bit body, the bit body having a superhydrophobic surface disposed over at least a portion thereof;

wherein the superhydrophobic surface comprises a patterned surface of a hydrophobic material exhibiting a higher hydrophobicity than an unpatterned surface of the hydrophobic material.

2. The wellbore tool of claim 1, wherein the patterned surface comprises a pattern having a first region at a first elevation and a second region at a second elevation, at least one of the first region and the second region having at least one lateral dimension of about 50 microns or less.

3. The wellbore tool of claim 2, wherein at least one of the first region and the second region comprises at least one of a plurality of pits and a plurality of mounds.

4. The wellbore tool of claim 3, wherein the at least one of a plurality of pits and a plurality of mounds comprises at least one of a plurality of pits and a plurality of mounds in an ordered pattern.

5. The wellbore tool of claim 3, wherein the at least one of a plurality of pits and a plurality of mounds comprises at least one of a plurality of pits and a plurality of mounds in a random arrangement.

6. The wellbore tool of claim 2, wherein at least one of the first region and the second region comprises a plurality of recesses.

7. The wellbore tool of claim 2, wherein the first elevation is within about 200 nm of the second elevation.

8. A wellbore tool, comprising:

a cutting element comprising a metal, the cutting element having a superhydrophobic surface disposed over at least a portion thereof;

wherein the superhydrophobic surface comprises a patterned surface of a hydrophobic material exhibiting a higher hydrophobicity than an unpatterned surface of the hydrophobic material.

9. A method of forming a wellbore tool, comprising:

forming a bit body comprising a metal and configured to retain at least one cutting element adjacent an outer surface of the bit body;

forming a hydrophobic surface over at least a portion of the body; and forming a patterned surface over the body, such that the patterned surface exhibits a higher hydrophobicity than an unpatterned surface comprising an identical chemical composition.

10. The method of claim 9, wherein forming a patterned surface over the body comprises forming a pattern having a first region at a first elevation and a second region at a second elevation, at least one of the first region and the second region having at least one lateral dimension of about 50 microns or less.

11. The method of claim 10, wherein forming a pattern comprises forming the first region at the first elevation within about 200 nm of the second elevation.

12. The method of claim 9, wherein forming a patterned surface over the body comprises selectively exposing a portion of the body to laser irradiation to remove material therefrom.

13. The method of claim 9, wherein forming a patterned surface over the body comprises selectively exposing a portion of the body to a plasma to remove material therefrom.

14. The method of claim 9, wherein forming a patterned surface over the body comprises forming at least one of a plurality of pits and a plurality of mounds.

15. The method of claim 14, wherein forming the at least one of a plurality of pits and a plurality of mounds comprises forming the at least one of a plurality of pits and a plurality of mounds in an ordered pattern.

16. The method of claim 9, wherein forming a patterned surface over the body comprises forming a plurality of troughs.

17. The method of claim 9, wherein forming a patterned surface over the body comprises simultaneously forming a pattern and forming the hydrophobic surface.

18. The method of claim 9, wherein forming a patterned surface over the body comprises forming a pattern over the hydrophobic surface.

19. The method of claim 9, wherein forming a hydrophobic surface comprises forming a hydrophobic surface over the patterned surface of the body.

20. The method of claim 9, wherein forming a patterned surface over the body comprises exposing portions of the body through a stencil.

21. The method of claim 20, wherein exposing portions of the body through a stencil comprises exposing a resin to ultraviolet light.

22. The method of claim 9, wherein forming a patterned surface over the body comprises exposing a portion of the body to galvanic pulse plating.

23. The method of claim 22, wherein galvanic pulse plating comprises forming a pattern of a nanoscale material over the body.

24. The method of claim 9, wherein forming a patterned surface over the body comprises forming a first pattern in a surface of the body and forming a second pattern over the first pattern.

25. The method of claim 9, wherein forming a hydrophobic surface comprises forming a first hydrophobic material over a surface of the body and forming a second hydrophobic material over the first hydrophobic material.

26. A wellbore tool, comprising:

a seal having at least one superhydrophobic surface;

at least one sensor having at least one superhydrophobic surface; and at least one flow line having at least one superhydrophobic surface;

wherein the superhydrophobic surfaces each comprise a patterned surface of a material having a higher contact angle with water than an unpatterned surface of the same material.

* * * * *

UNITED STATES PATENT AND TRADEMARK OFFICE

CERTIFICATE OF CORRECTION

PATENT NO. : 8,746,375 B2
APPLICATION NO. : 13/111825
DATED : June 10, 2014
INVENTOR(S) : Hendrik John and Sunil Kumar It is certified that error appears in the above-identified patent and that said Letters Patent is hereby corrected as shown below:

On the title page:

In ITEM (12) United States Patent: change "Hendrik et al." to --John et al.--

In ITEM (75) Inventors: change "John Hendrik," to --Hendrik John,--

In the specification:

COLUMN 11, LINE 4, change "foamed" to --formed--

Signed and Sealed this
Twenty-eighth Day of July, 2015

Michelle K. Lee

Michelle K. Lee
*Director of the United States Patent and Trademark Office*